United States Patent [19]

Iwamoto et al.

[11] 3,954,294

[45] May 4, 1976

[54] PLASTIC SEALING DEVICE

[75] Inventors: Mitsuru Iwamoto, Hachioji; Toshie Tanaka, Machida, both of Japan

[73] Assignees: Nishiei Bussan Co., Ltd.; Nifco Inc., both of Tokyo, Japan

[22] Filed: Apr. 16, 1975

[21] Appl. No.: 569,325

[30] Foreign Application Priority Data

Apr. 26, 1974 Japan ..... 49-47011[U]

[52] U.S. Cl. ..... 292/318

[51] Int. Cl.[2] ..... B65D 33/34

[58] Field of Search ..... 292/318, 320, 321, 319, 292/322

[56] References Cited

UNITED STATES PATENTS 3,556,575 1/1971 Farkas ..... 292/318

*Primary Examiner*—Richard E. Moore

*Attorney, Agent, or Firm*—Jack R. Halvorsen; Robert W. Beart

[57] ABSTRACT

Disclosed is a plastic sealing device comprising a hollow, bottomless cubic body and a sealing strip integrally connected to and extending from said cubic body. The sealing strip has an arrowhead-shaped end, and in use, the arrowhead-shaped end of the strip is inserted in the slits of the hollow cubic body, and is pulled out of the cubic body, thus passing therethrough and closing the open bottom of the cubic body. After passing through the apertures of an object to be sealed, the arrowhead of the strip is inserted in a slit in the top plate of the cubic body until it is caught by catch means within the cubic body. The structure of the sealing device is conveniently amenable to plastic injection moulding and mass-production.

6 Claims, 3 Drawing Figures

PLASTIC SEALING DEVICE

This invention relates to a plastic sealing device.

One object of this invention is to provide a plastic sealing device which is easy to handle and assures the complete sealing of an object to be sealed.

Another object of this invention is to provide a plastic sealing device which is conveniently amenable to plastic injection moulding, and hence to mass-production.

To attain these objects a plastic sealing device according to this invention comprises a hollow, bottomless cubic body having a top wall, and front and back walls and left and right side walls, said top wall having a slot, and said left and right side walls having slots along the lower edges thereof; a length of strip having an arrowhead-shaped end and being integrally connected to one side of said top wall at the end opposite to said arrowhead-shaped end; and two resilient legs forming a tapered throat or catch and being integrally connected to the inside, opposite edges said slit of said top wall.

Figure 1:
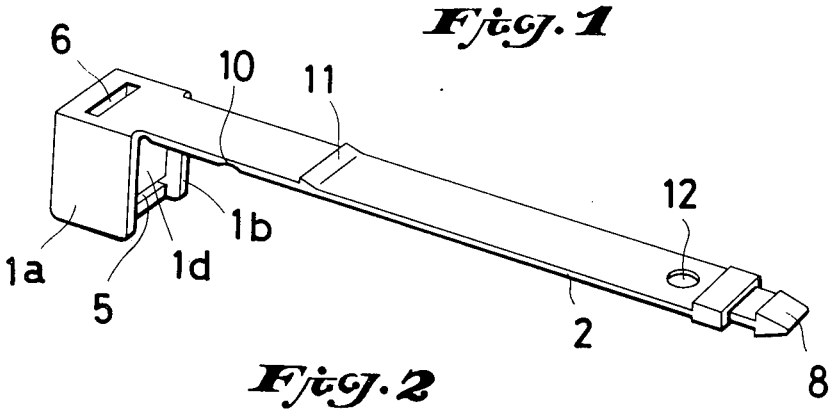
Figure 2:
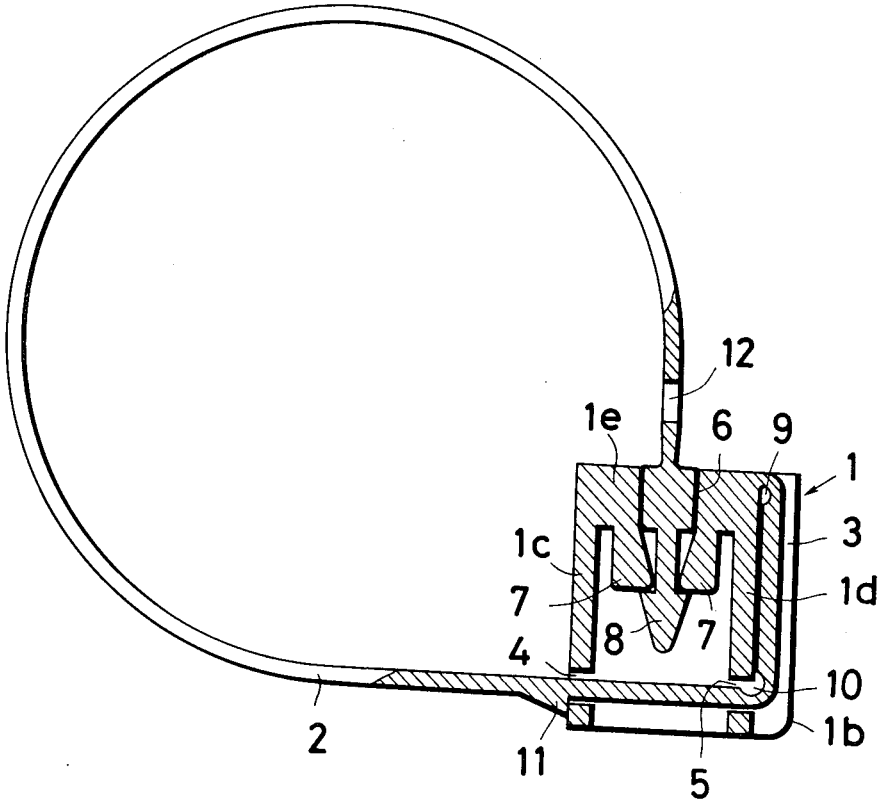

The objects and advantages of this invention will be understood from the following description which is made with reference to the accompanying drawings wherein:

FIG. 1 shows, partly in section, a plastic sealing device according to this invention; and FIG. 2 shows another embodiment of this invention.

Referring to FIGS. 1 and 2, 1 is a locking body which is shaped in a hollow cubic form comprising a top wall 1*e*, front and back walls 1*a* and 1*b*, and left and right side walls 1*c* and 1*d*, and 2 is a length of strip integrally connected to the top wall and extending perpendicular to the major surface of the right side wall. The top wall and front and back walls and two side walls together form a bottomless box. The right side wall 1*d* is shifted somewhat inside, thus forming recess portion 3 with the opposite projections of the side walls 1*e* and 1*d*. The right and left side walls have slots 4 and 5 respectively to allow the free end of the strip 2 to pass through the cubic body.

As is best shown in FIG. 2, the cubic seal body comprises a top wall 1*e*, front and back walls 1*a* and 1*b* and two side walls 1*c* and 1*d*, but the cubic locking body has no bottom. The top wall has an extended window opening or slot 6 therein. The inside surface of the top wall has two opposing resilient legs 7 extending from the opposite edges of the window opening and forming a tapered throat.

The strip 2 integrally connected to the top wall has the same width as the side wall, and the free end of the strip has an engaging portion 8 in the form of an arrowhead. The root or shouldered portion of the arrowhead extends at either side of the strip in the thickness direction.

As shown in FIG. 2, the arrowhead-shaped end of the strip is inserted in the bottom slits of the side walls and is pulled out of the hollow cubic body, and then the arrowhead-shaped end is pushed in the window opening of the top wall so that it is caught by the resilient leg catch within the cubic locking body. Thus, the strip is put in a closed loop as shown in the drawings. The strip has two hinge portions 9 and 10 at the places where the strip is bent in use. Specifically, the strip has a first hinge portion 9 at the joint portion between the strip and the top wall, and it has a second hinge portion 10 at the place where it is bent and inserted in the bottom slit of the right side wall 1*d*. Thus, the strip is easily bent at the first hinge portion so that it is laid on the surface of the right side wall, and it is snugly received in the recess space 3, which is defined by the right side wall and the opposite projections of the front and back walls. The strip is again bent at the second hinge portion 10, and the arrowhead-shaped end of the strip is inserted in the bottom slits of the opposite side walls, and then the free end of the strip is pulled out of the hollow cubic body. Thus, the bottom slit opening are closed by the thickness of the strip. For this closing purpose, and at the same time for preventing the strip from slipping in the bottom slits of the cubic body, the slit opening has such a dimension that the strip fits tightly in the slit opening. The strip after passing through the bottom slot 4 of the left side wall, is prevented from returning by a locking means such as a nonreturn ramp shoulder 11. This ramp shoulder 11 is raised on the strip, and is caught by the wall adjacent the bottom slot of the left side wall after passing therethrough. The arrowhead-shaped portion of the strip, after the opposite end of the strip has been locked in place and closes the open bottom of the cubic body, is inserted in the apertures of an object to be sealed, such as the lids of a box, and then the free end of the strip is pushed in the top window or slot 6 of the top wall 1*e*, so that the shoulders of arrowhead end 8 of the strip is caught by the normally disposed ends of opposite legs 7, 7 within the hollow cubic body, thus completing the sealing of the object (See FIG. 2).

As is apparent from the above, the seal body is made in the form of hollow and bottomless cubic, and in use, the open bottom is closed by the strip 2, which is integrally connected to the top wall of the cubic body, and in use, is inserted in the bottom slots 4, 5 of the opposite side walls. After closing the open bottom of the hollow cubic body, the arrowhead of the seal strip is pushed in the top window 6 of the top wall of the cubic body so that it is caught by the legs 7, 7 within the cubic body. Thus, once the sealing of an object has been completed, the object cannot be unsealed without cutting the strip or breaking the cubic locking body to release the arrowhead of the strip from the legs 7, 7. Thus, the sealing of an object is assured.

As mentioned above, the sealing operation is easily performed by inserting the arrowhead-shaped end of the strip into the bottom slots of the hollow cubic body and by pulling the free end of the strip out of the cubic body and finally by pushing it into the window opening of the top plate of the cubic body. The sealing device according to this invention is so constructed that a length of strip is integrally connected to the top plate of the bottomless, hollow cubic body, and thanks to this structure the plastic injection moulding method can be advantageously used in integrally connecting to a bottomless, hollow cubic body both of the strip and the locking legs, and therefore the device can be mass-produced at a low cost.

Figure 3:
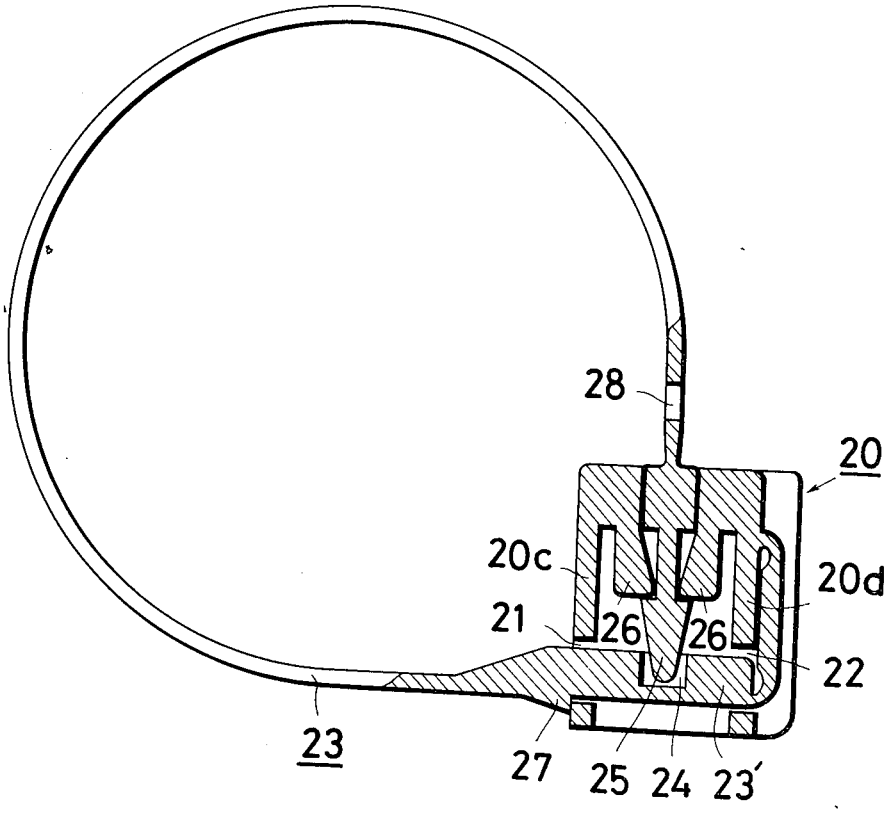

Referring to FIG. 3, there is shown another embodiment according to this invention. The bottomless, hollow cubic body 20 has bottom slots 21 and 22 on the opposite side walls 20*c* and 20*d* thereof in the vicinity of the bottom edges of the side walls. The strip 23 has a thick portion 23' at a place where the strip in use, is inserted and remains within the hollow cubic body 20. The thick portion of the strip has a groove 24 across the width of the strip. When the arrowhead-shaped end 25 of the strip is pushed in the window opening of the top wall of the hollow cubic body, the arrowhead is snugly received in the groove 24 of the thick portion of the strip, and at the same time the arrowhead is caught by the locking legs 26. The arrowhead of the strip when inserted in the groove of the thick portion of the strip, serves to positively prevent the longitudinal movement of the strip length within the open end of body 1, thus effectively preventing the cubic body from being forcibly opened with a tool such as a screw driver. A ramp portion and shoulder 27 may be provided to one surface of the strip to catch the edge of the bottom slot of the hollow body. Thus, the movement of the strip is prevented in a double fashion. The strip 23 may have a bulge portion at a place where the strip when inserted in the window opening of the top wall of the hollow cubic, is brought to face the opposite edges of the window opening. Such bulge portion serves to completely fill the window opening, thus preventing access from the exterior to the inside of the hollow cubic body, and hence preventing the locking legs 26 from being forcedly opened so as to release the arrowhead of the strip. The strip 23 may have a fragile portion in the vicinity of the bulge portion on the strip. As shown in the drawings, such fragile portion may be made in the form of an apertured portion as indicated at 12 in FIG. 2 and at 28 in FIG. 3. Otherwise, it may be made by partially reducing the thickness of the strip. This permits unsealing simply by stretching the strip to break it at the reduced portion.

What is claimed is:

1. A plastic sealing device comprising: a hollow, bottomless cubic body having a top wall, and front and back walls and left and right side wall, said top wall having a slot, and said left and right side walls have slots along the lower edge thereof; a length of strip having a width acceptable within said slots in the side walls and including at its free end an arrowhead-shaped portion and said strip being integrally connected to said top wall at the end thereof opposite to said arrowhead-shaped end; said strip being adapted to be positioned along one side wall and thence bent to pass through said slots in a position extending between said side walls to substantially close the bottom of said body, and two resilient legs integrally connected to the inside, opposite edges of said slot of said top wall forming a throat terminating in abrupt shoulders capable of accepting and locking said arrowhead-shaped portion at the free end of said strip.

2. A plastic sealing device according to claim 1 wherein said strip has a ramp portion terminating in an abrupt shoulder to catch the edge of said slot of one of said side walls in a non-return fashion after passing therethrough.

3. A plastic sealing device according to claim 1 wherein said strip has a groove across the width of the strip to receive the arrowhead of said strip when inserted through said slot of said top wall.

4. A plastic sealing device according to claim 1 wherein said strip has two hinge portions, one hinge being located at the juncture of said strip and top wall and the second hinge being adjacent a side wall slot when the strip is laid along said side wall slot.

5. A plastic sealing device according to claim 1 wherein said strip has a fragile portion for ready highly visible fracture of said strip.

6. A plastic sealing device according to claim 1 wherein one of said side walls has a recess portion to receive the strip when folded and laid on the major surface of said side wall.

* * * * *